US008087574B1

(12) United States Patent
Harris

(10) Patent No.: US 8,087,574 B1
(45) Date of Patent: Jan. 3, 2012

(54) MAILBOX AND METHOD

(76) Inventor: Howard D. Harris, Candor, NC (US)

( * ) Notice: Subject to any disclaimer, the term of this patent is extended or adjusted under 35 U.S.C. 154(b) by 0 days.

(21) Appl. No.: 13/019,418

(22) Filed: Feb. 2, 2011

Related U.S. Application Data

(60) Provisional application No. 61/326,342, filed on Apr. 21, 2010.

(51) Int. Cl.
*A47G 29/14* (2006.01)

(52) U.S. Cl. ..... 232/35

(58) Field of Classification Search ..... 232/35, 232/34, 17, 45; 116/284, 309
See application file for complete search history.

(56) References Cited

U.S. PATENT DOCUMENTS

| | | | | | |
|---|---|---|---|---|---|
| 879,022 | A | * | 2/1908 | Wolf | 232/34 |
| 2,954,920 | A | * | 10/1960 | Harger | 232/35 |
| 3,026,024 | A | * | 3/1962 | Holmgren et al. | 232/35 |
| 3,034,706 | A | * | 5/1962 | Wing | 232/35 |
| 3,291,386 | A | * | 12/1966 | Fleet | 232/35 |
| 3,581,980 | A | | 6/1971 | Kreycik | 232/35 |
| 3,620,443 | A | | 11/1971 | Sturtz et al. | 232/35 |
| 3,680,524 | A | | 8/1972 | Korinek et al. | 116/132 |
| 3,722,460 | A | * | 3/1973 | James, Sr. | 232/35 |
| 4,063,681 | A | | 12/1977 | Tong | 232/34 |
| 4,073,430 | A | | 2/1978 | Joris | 232/35 |
| 4,150,780 | A | * | 4/1979 | Mapes | 232/35 |
| 4,158,430 | A | | 6/1979 | Wideman | 232/35 |
| 4,190,193 | A | | 2/1980 | Smith | 232/35 |
| 4,202,486 | A | | 5/1980 | Tipsword | 232/35 |
| 4,220,278 | A | * | 9/1980 | Hasselbring | 232/35 |
| 4,262,839 | A | | 4/1981 | Wisniewski | 232/35 |
| 4,290,549 | A | | 9/1981 | Getz, Jr. | 232/35 |
| 4,316,575 | A | | 2/1982 | VanDarwarka | 232/35 |
| 4,318,507 | A | | 3/1982 | Thopsey et al. | 232/35 |
| 4,365,740 | A | | 12/1982 | Whitley et al. | 232/35 |
| 4,382,541 | A | | 5/1983 | Miller | 232/35 |
| 4,390,122 | A | | 6/1983 | Savko | 232/35 |
| 4,447,005 | A | | 5/1984 | Kelly et al. | 232/35 |
| 4,449,663 | A | * | 5/1984 | Schluter | 232/35 |
| 4,473,182 | A | | 9/1984 | Dion | 232/35 |
| 4,488,677 | A | | 12/1984 | Guest, Sr. | 232/34 |
| 4,524,905 | A | | 6/1985 | Crist | 232/35 |
| 4,651,135 | A | | 3/1987 | Duhaime et al. | 340/569 |
| 4,706,880 | A | * | 11/1987 | Peters | 232/35 |
| 4,728,028 | A | | 3/1988 | Barnes et al. | 232/35 |
| 4,738,392 | A | | 4/1988 | Kovacs | 232/35 |
| 4,756,472 | A | | 7/1988 | Hammons | 232/35 |
| 4,883,223 | A | | 11/1989 | Taniguchi | 232/35 |
| 5,004,148 | A | | 4/1991 | Windrem | 232/35 |
| 5,060,854 | A | | 10/1991 | Armstrong | 232/37 |
| 5,076,337 | A | | 12/1991 | Reuter | 160/35 |
| 5,094,386 | A | | 3/1992 | Tabacco | 232/35 |
| 5,123,590 | A | | 6/1992 | Teele | 232/35 |
| 5,178,321 | A | | 1/1993 | Majewski | 232/17 |
| 5,201,465 | A | | 4/1993 | Limehouse | 232/35 |
| 5,366,148 | A | | 11/1994 | Schreckengost | 232/35 |
| 5,489,064 | A | | 2/1996 | Shively | 232/34 |
| 5,660,327 | A | | 8/1997 | Brinkley, Jr. | 232/35 |

(Continued)

*Primary Examiner* — William L. Miller

(57) ABSTRACT

A mailbox kit is provided for retrofitting a standard mailbox. The kit includes a rear signal flap and hinge to allow the signal flap to pivot from a horizontal position to a vertical position to come into contact with the rear panel of the mailbox during mail insertion into the mailbox. The large, rear signal flap contains indicia for a homeowner to easily view from a remote location. The rear signal flap is joined to a wheeled control bar connected by a front linkage to the front door of the mailbox. Thus as the front door is opened the rear signal flap raises 90° alerting the homeowner that mail has been delivered.

12 Claims, 6 Drawing Sheets

U.S. PATENT DOCUMENTS

| | | | | |
|---|---|---|---|---|
| 5,769,312 | A * | 6/1998 | Lampe | 232/35 |
| 5,816,489 | A | 10/1998 | Stockman | 232/35 |
| 5,865,368 | A | 2/1999 | Taylor et al. | 232/35 |
| 5,927,596 | A | 7/1999 | Trenier | 232/35 |
| 5,964,401 | A | 10/1999 | Thill | 232/35 |
| 6,053,404 | A | 4/2000 | Jefferson et al. | 232/35 |
| 6,308,884 | B1 | 10/2001 | Hamburger | 232/38 |
| 6,371,367 | B1 | 4/2002 | Otero | 232/35 |
| 6,425,521 | B1 | 7/2002 | Cooper | 232/34 |
| 6,659,337 | B2 | 12/2003 | Woelfel | 232/35 |
| 7,007,839 | B1 | 3/2006 | Piccolo | 232/35 |
| 7,014,097 | B1 * | 3/2006 | Gaillard et al. | 232/35 |
| 7,025,250 | B2 | 4/2006 | Wolfe, Jr. | 232/35 |
| 7,028,883 | B1 | 4/2006 | Choi | 232/35 |
| 7,270,260 | B1 | 9/2007 | Powers | 232/35 |
| 7,552,858 | B1 | 6/2009 | Owens | 232/35 |
| 2002/0152949 | A1 | 10/2002 | Turner | 116/284 |
| 2006/0102710 | A1 | 5/2006 | Griffeth | 232/34 |

* cited by examiner

MAILBOX AND METHOD

This non-provisional patent application claims all benefits under 35 U.S.C. §119(e) of pending U.S. provisional patent application Ser. No. 61/326,342 filed 21 Apr. 2010, entitled "KIT TO ADD TO MAIL BOX TO SHOW YOU WHEN YOU HAVE MAIL", in the United States Patent and Trademark Office.

FIELD OF THE INVENTION

The invention herein pertains to mailboxes and particularly pertains to stand alone mailboxes which are placed along roads or streets at a remote position from a house or other dwelling. A pivotable signal flap attached to the rear of the mailbox alerts the home owner when mail has been delivered.

BACKGROUND AND OBJECTIVES OF THE INVENTION

Roadside mailboxes are often placed one hundred to two hundred or more feet from a dwelling. Consequently mail is delivered at unpredictable times during the day and week sometimes causing a homeowner to walk a long distance just to determine if mail has been delivered. This can be a great inconvenience especially during winter and other periods of adverse weather, particularly for the elderly and the infirm. Other mailboxes in the past have used indicators to allow homeowners to visually determine mail delivery such as seen in Publication No. US 2002/0152949 which causes a gravity fall of a small signal element.

In order to better remedy this problem and provide comfort and convenience to the homeowner and to effectively communicate an alert of all mail deliveries, the present invention was conceived and one of its objectives is to provide an inexpensive solution to an age old problem.

It is another objective of the present invention to provide a relatively large signaling device for easily attaching to a mailbox which will visually alert the homeowner when mail is delivered.

It is still another objective of the present invention to provide a mailbox with a wheeled control bar which is affixed by a front linkage to the front door and to a pivotable rear signal flap by a rear bracket which, during operation will cause the signal flap to raise from an obscured horizontal position to a prominent vertical position when the front door is opened during mail insertion.

It is yet another objective of the present invention to provide a large, rigid signal flap for a mailbox which includes indicia thereon for easily viewing by a homeowner from a remote location for determining mail delivery.

It is a further objective of the present invention to provide a rear signal flap which when raised to a vertical position is magnetically, releasably joined to the rear panel of the mailbox to prevent wind or other adverse weather conditions from causing the signal flap to inadvertently pivot downwardly to its former obscure horizontal position.

It is yet a further objective of the present invention to provide a kit to retrofit a typical mailbox with a signal flap and operating mechanism.

Various other objectives and advantages of the present invention will become apparent to those skilled in the art as a more detailed description is set forth below.

SUMMARY OF THE INVENTION

The aforesaid and other objectives are realized by providing a mailbox with a large pivotable signal flap approximately the size of the rear panel of the mailbox hingedly affixed to the rear panel of the mailbox. The pivotable signal flap is joined by a rear bracket to a wheeled control bar which in turn is also joined by a front linkage to the mailbox front door. The signal flap is attached by a hinge to the rear panel of the mailbox receptacle. The rear bracket includes a long planar section and an arcuate section having a slot therein for slideably receiving the control bar and providing a smooth surface for a pair of opposingly positioned wheels on the control bar to roll against. The wheels are positioned proximate the arcuate section slot for engaging and rolling against the arcuate section of the rear bracket, ultimately forcing or pivoting the signal flap upwardly 90° from a horizontal position to an upright, easily observable vertical position. When the signal flap is in its downward, horizontal position the terminal end of the arcuate section abuts the bottom surface of the control bar to prevent further downward pivoting of the signal flap.

In use, the large signal flap is manually placed in a horizontal position with the front door of the mailbox closed. When the front door is pulled downwardly or opened for mail insertion the front linkage causes the attached control bar to push or move rearwardly, through the rear bracket arcuate slot so the pair of wheels engage with and cause the arcuate section of the rear bracket to roll therealong simultaneously pivoting the signal flap to a vertical or upright position. The rearward force of the control bar wheels pushing or rolling against the arcuate section of the rear bracket causes the signal flap to raise to the vertical, upright position. After mail is inserted the front door is closed causing the front linkage and control bar to pivot and return to their initial position. The signal flap remains upright and releasably attached to the rear panel of the mailbox such as by magnets, clips or other connectors. The outside or rear of the signal flap contains indicia thereon such as a painted bulls-eye, wording such as "YES" or both for easy viewing by the homeowner to indicate the arrival of mail. Thus, when the homeowner looks at the rear of the mailbox and the signal flap is visible, mail has been delivered and the homeowner then knows to retrieve the mail.

The method of alerting the homeowner or communicating delivery to the mailbox includes the step of retrofitting a mailbox with a signal flap as hereinbefore described which is connected to the wheeled control bar and is hingedly joined to the rear of the mailbox. As the control bar is pivotably joined to a front door linkage, by opening the front door the signal flap is raised when the wheels meet and roll with force against the arcuate section of the rear bracket forcing the arcuate section to roll therealong pivoting the signal flap upwardly.

With the signal flap placed in its downward (horizontal) position, opening the front door will drive the control bar and wheels rearwardly causing the signal flap to pivot to an easily observable upright or vertical position. Magnets, clips or other connectors on the inside surface of the signal flap will releasably attach to the rear panel of the mailbox receptacle causing the signal flap to remain in an upright position during windy or other adverse weather conditions. Once mail is inserted into the mailbox the front door is typically closed and the mailbox is then available for viewing and alerting of the homeowner of delivered mail so retrieval can be carried out as convenient.

A kit is provided for retrofitting a conventional mailbox which includes a front door linkage, a wheeled control bar, axle nuts and bolts, a rear bracket, a hinge and a signal flap along with conventional nuts and bolts and assembly instructions for standard mailboxes.

In an alternate embodiment, for convenience to homeowners having their mailboxes positioned across a street and can only see the front of the mailbox from their houses, the signal flap can be reversed and attached to the rear receptacle whereby the signal flap will be to the side of the mailbox receptacle rather then directly behind it. The indicia on the signal flap when raised will be facing the front of the mailbox for easily viewing from the front.

DETAILED DESCRIPTION OF THE PREFERRED EMBODIMENT AND OPERATION OF THE INVENTION

Figure 1:
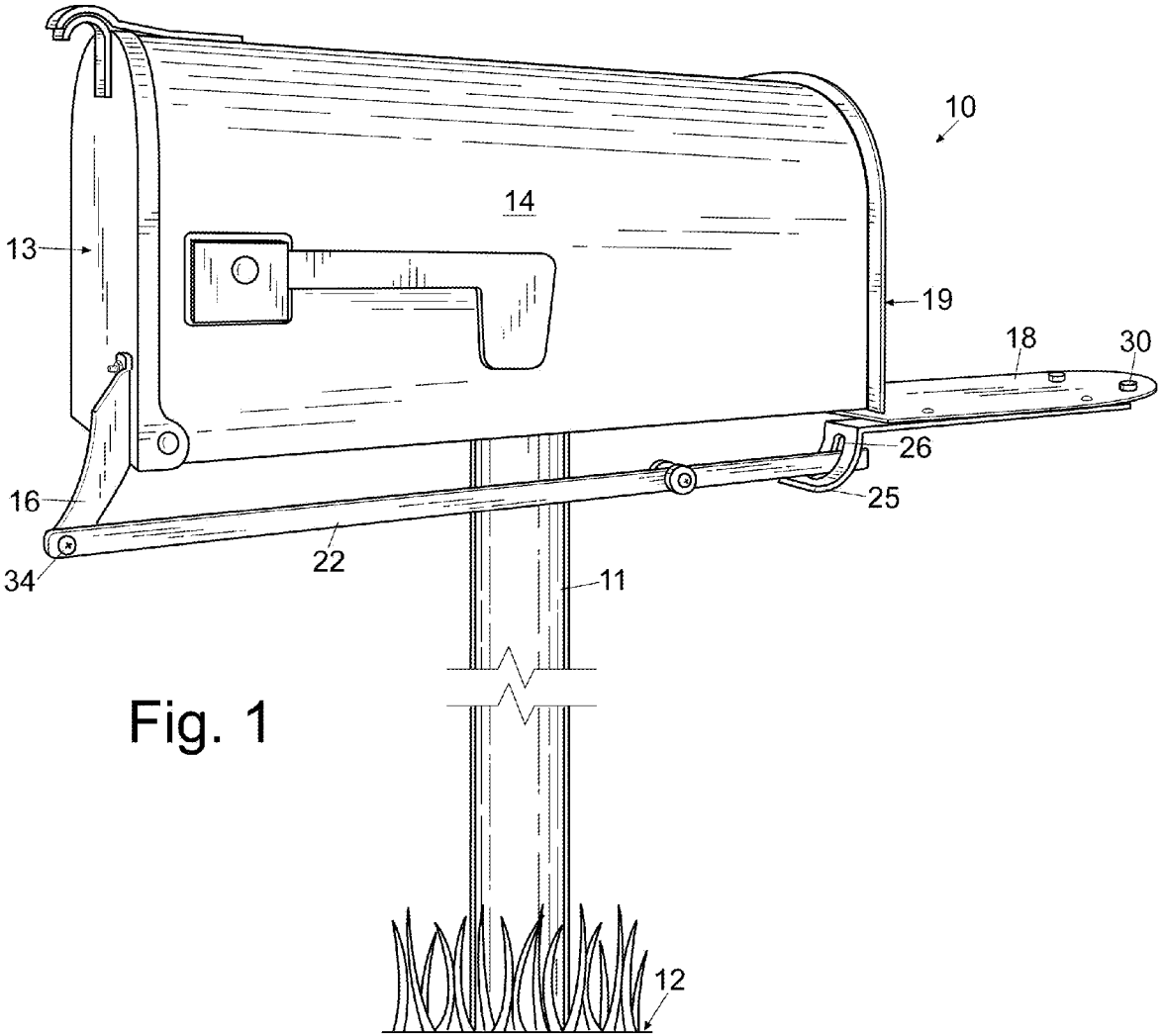
FIG. 1 illustrates a perspective view of a mailbox in closed configuration mounted on a ground post with the signal flap of the invention attached thereto and in a horizontal, obscure position.
Figure 2:
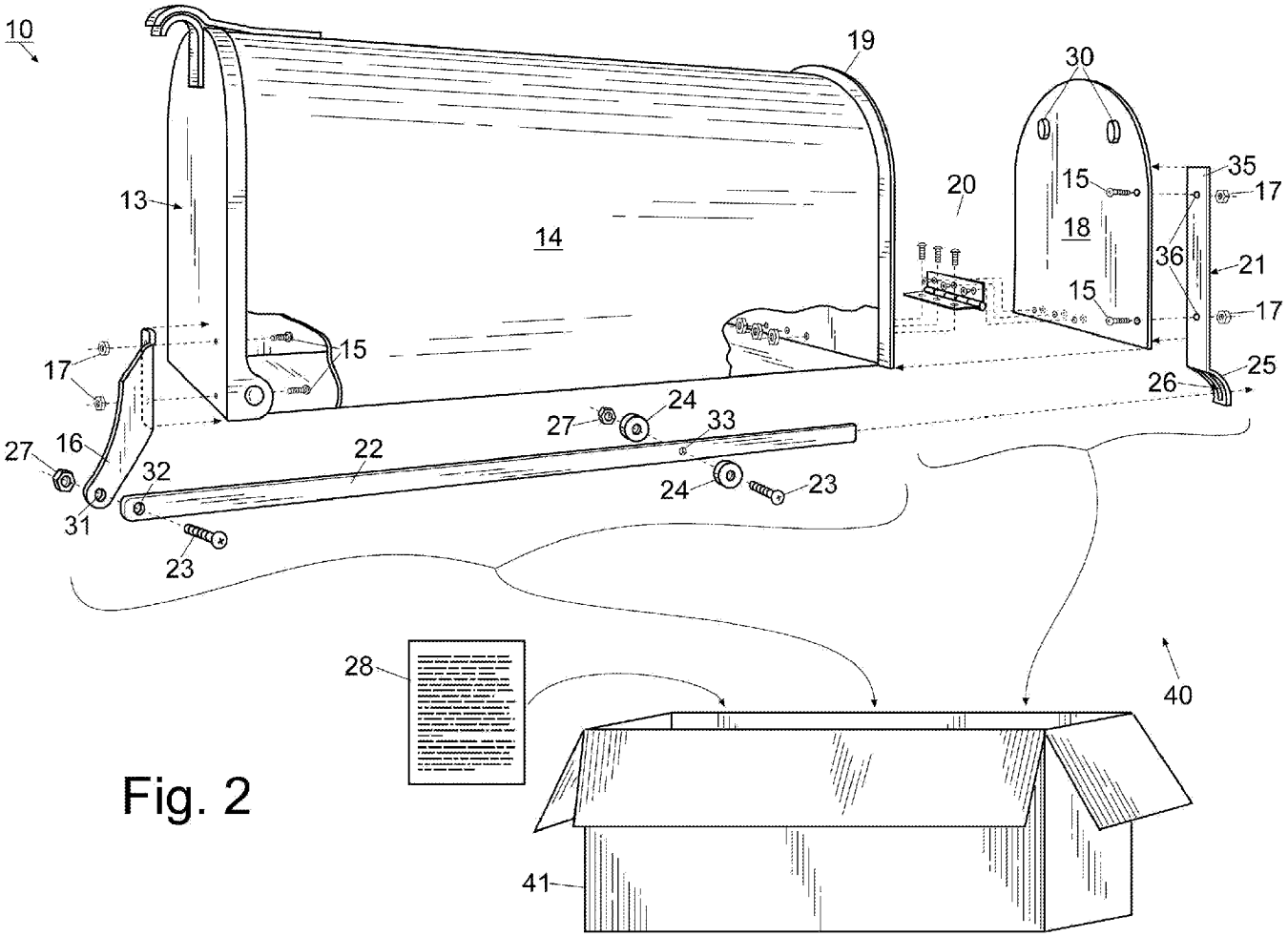
FIG. 2 depicts the mailbox of FIG. 1 with sections cutaway and removed from the post with the signal flap and other components in exploded fashion before placement in the container of the kit for shipping purposes.
Figure 5:
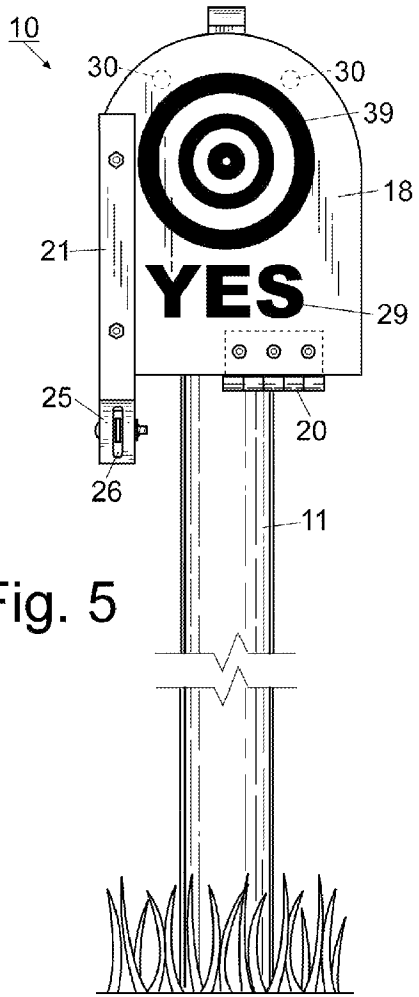
FIG. 5 demonstrates a rear view of the mailbox and signal flap raised as shown in FIG. 4.
Figure 3:
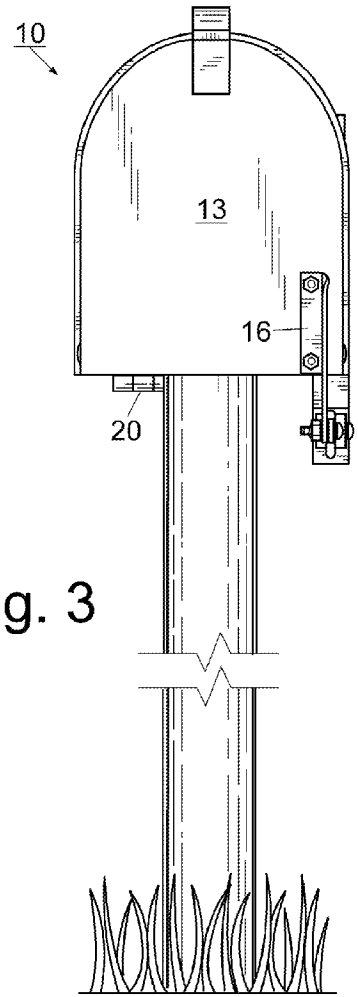
FIG. 3 shows a front view of the mailbox as seen in FIG. 1 but with the signal flap raised.
Figure 4:
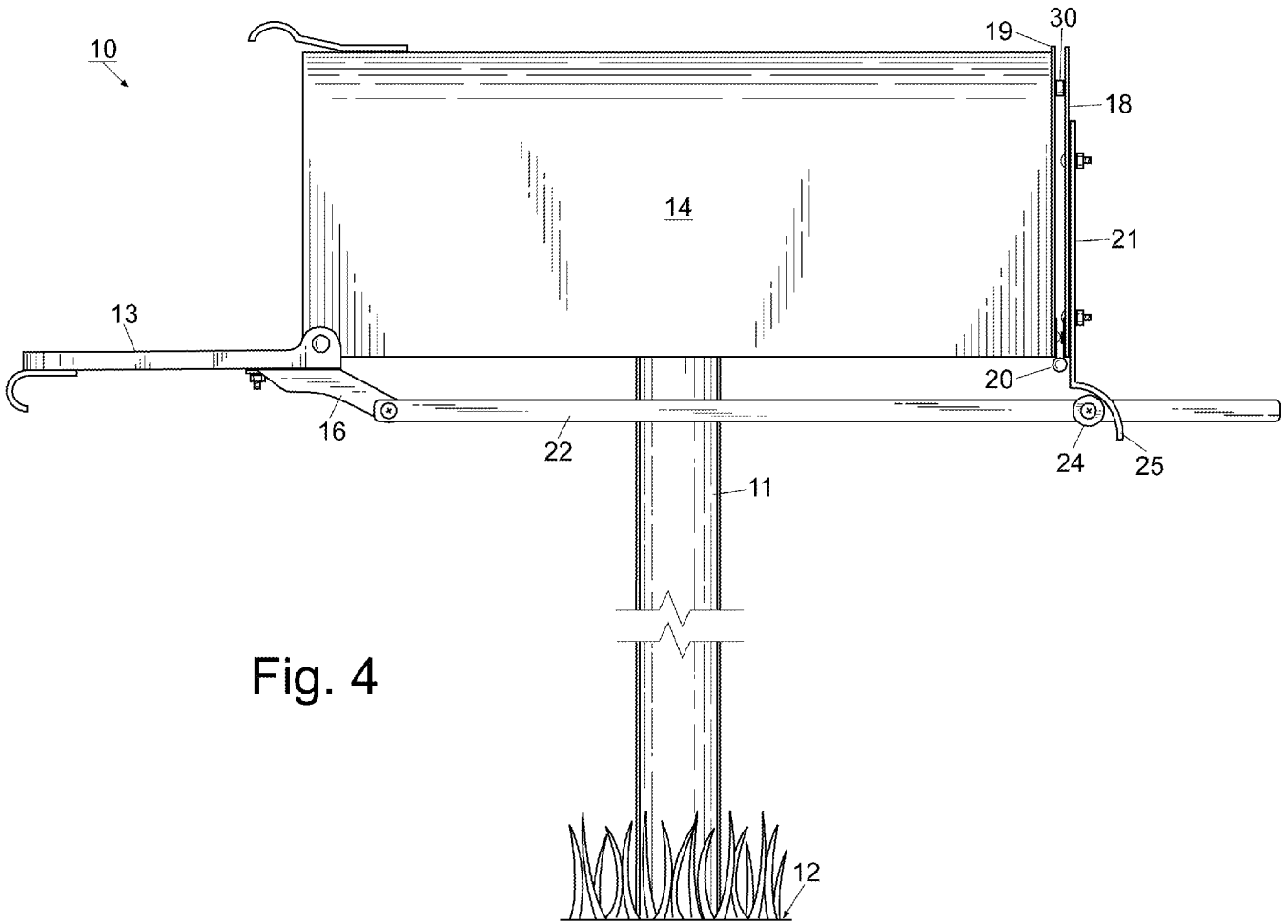
FIG. 4 pictures a right side view of the mailbox and signal flap as seen in FIG. 1 with the front door of the mailbox in an open configuration and the signal flap raised to a vertical position.
Figure 6:
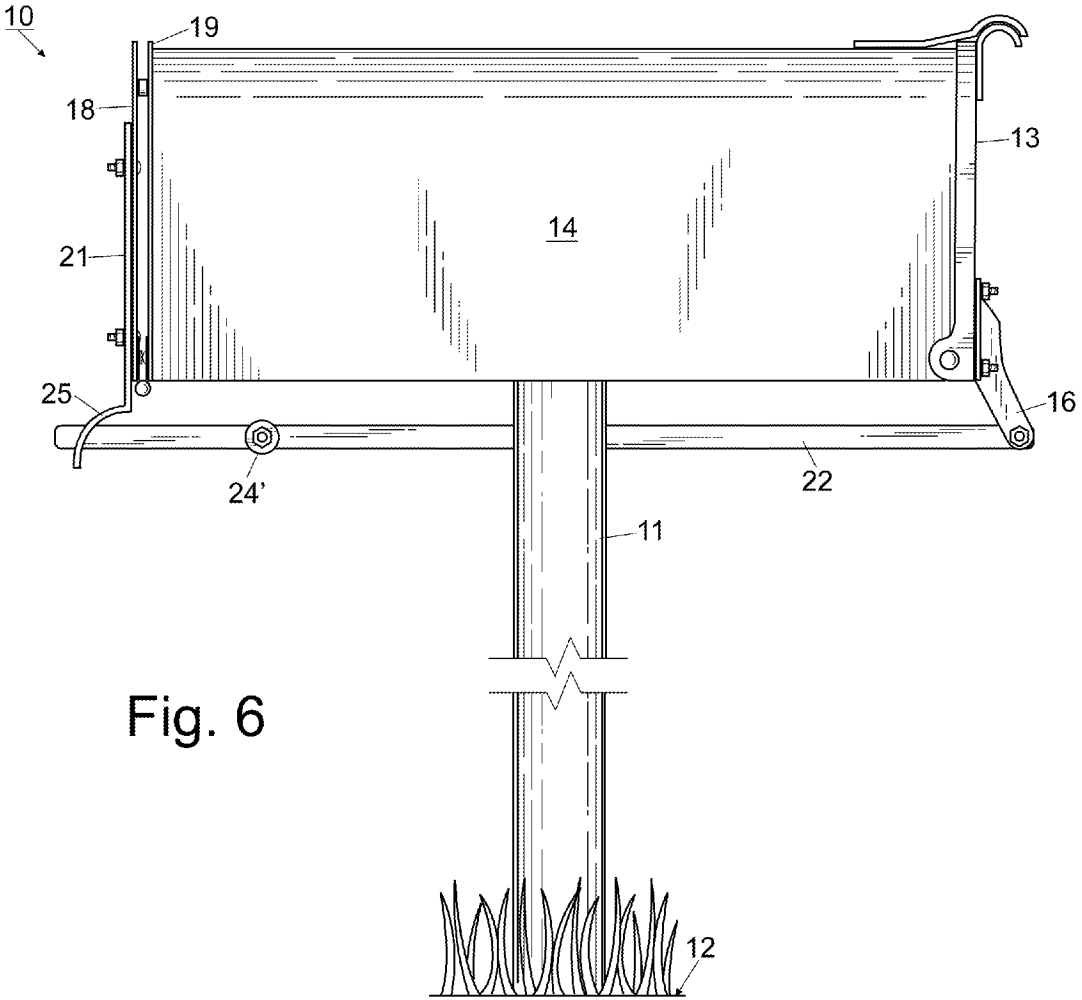
FIG. 6 illustrates a left side view of the mailbox and signal flap as seen in FIG. 4 with the front door of the mailbox closed and the signal flap raised to a vertical position for alerting the homeowner of mail delivery.

For a better understanding of the invention, its operation and method of use, turning now to the drawings, FIG. 1 illustrates preferred retrofitted mailbox 10 affixed atop cylindrical post 11 which is positioned in ground 12 as conventional. Mailbox 10 as seen in FIGS. 1 and 3 includes front door 13 hingedly joined to mail receptacle 14 having rear panel 19 (FIG. 2). Front door 13 includes front linkage 16 affixed thereto such as by bolts 15 and nuts 17 (FIG. 2), screws or the like. Pivotally affixed to rear panel 19 is signal flap joined thereto by hinge 20 which is bolted to the bottom outside of rear panel 19 and to the bottom inside surface of signal flap 18 by bolts 15 and nuts 17 as also seen in FIGS. 4, 5 and 6. Preferred hinge 20 rotates at least 90°, however a hinge having a greater rotation range could also be utilized. As would be understood, mailbox 10 is shown closed in FIG. 1 with front door 13 closed and positioned against receptacle 14 as conventional and rigid rear signal flap 18 formed for example from aluminum or other metal is in an open, obscure horizontal position.

In exploded FIG. 2, front linkage 16, control bar 22 with wheels 24, 24', axle bolts 23 with corresponding nuts 27, rear bracket 21 having planar section 35 and arcuate section 25 with slot 26 therein, signal flap 18, hinge 20 and bolts 15 with corresponding nuts 17, are seen prior to assembly on typical metal mailbox 10. Kit 40 includes a container such as cardboard box 41 for maintaining and shipping the signal flap and other components along with assembly instructions 28 as seen in FIG. 2 for simple retrofitting and attachment to a usual mailbox by purchasers. As would be understood bolts 15 and nuts 17 are utilized in the connection of front linkage 16 to front door 13, hinge 20 to rear panel 19 and to signal flap 18 and rear bracket to signal flap 18 while axle bolts 23 and nuts 27 are utilized for rotatable connection of front linkage 16 to control bar 22 and wheels 24, 24' to control bar 22.

Control bar 22 is preferably formed from a rigid metal and includes a pair of opposingly positioned wheels 24, 24' rotatably affixed thereto through aperture 33 by axle bolt 23 and nut 27 for engaging arcuate section 25 of rear bracket 21 as control bar 22 passes through slot 26 to engage and raise signal flap 18. As seen in FIG. 1, when signal flap 18 is in its downward, horizontal position the terminal end of arcuate section 25 of rear bracket 21 abuts the bottom surface of control bar 22 to prevent further downward pivoting of signal flap 18. This further assists in supporting and maintaining signal flap 18 in its horizontal position. Control bar 22 also includes aperture 32 proximate the end thereof for rotatably affixing control bar 22 to front linkage 16 by axle bolt 23 and nut 27. Front linkage 16 is also formed from a rigid metal having a planar rectangular portion with a pair of apertures (not shown) for affixing to front door 13 by bolts 15 and nuts 17 and includes an outwardly extending somewhat J-shaped portion with aperture 31 for rotatable connection with control bar 22 using axle bolt 23 and nut 27. Arcuate section 25 allows for smooth, positive rolling of wheels 24, 24' thereagainst to prevent jams and sticking as front door 13 is opened and signal flap 18 pivots upwardly approximately ninety degrees (90°). In many rural areas roads are not paved and exposed mechanisms can become locked and jammed due to the constant barrage of road dust and debris. Arcuate section 25 assists in the smooth durable operation of wheels 24, 24' which engage arcuate section 25 as demonstrated in FIG. 4 to smoothly rotate signal flap 18 to an upward, highly visible vertical position. Screws, axle bolts 23, nuts 27, bolts 15, nuts 17 and clips (not shown) along with printed assembly instructions 28 are also included in kit 40. Magnets 30 are mounted with a durable adhesive such as a commercial epoxy on the inside surface of signal flap 18 to releasably grip rear panel 19 (FIG. 4) and hold it in a parallel position against rear panel 19. Rear bracket 21 assists in supporting and rotation of signal flap 18 during use and is also formed from a rigid metal and includes an elongated planar section 35 having apertures 36 therein and lower arcuate section 25 with slot 26 therein for slideably receiving control bar 22. Rear bracket 21 is affixed to the outside surface of signal flap 18 such as by conventional bolts 15 and nuts 17 and contains slot 26 in arcuate section 25 in which control bar 22 resides.

In FIG. 4, mailbox 10 is shown with front door 13 fully opened and signal flap 18 fully raised to display indicia such as bulls-eye 39 and printed text 29 (YES) (FIG. 5) on the outside surface of signal flap 18. The word "YES" has been printed on the outside of signal flap 18 for viewer convenience and clarity purposes to indicate mail delivery. Magnets 30 are rigidly affixed to the inside surface of signal flap 18 and are attracted to rear panel 19 of receptacle 14 when signal flap 18 is pivoted to a vertical posture as shown in FIGS. 4 and 6 as receptacle 14 is generally formed of a thin ferromagnetic material although manufacturing may be dictate that some components be made of plastic or other suitable materials. Usual plastic clips, not seen can be placed on the edges of signal flap 18 to hold it in a regular upright position against rear panel 19 should rear panel 19 be formed from a plastic or other non-ferrous or nonmagnetic material.

In use, after preferably retrofitting a standard mailbox using kit 40 and standard tools such as an electric drill, a screwdriver and a crescent wrench (not shown) according to instructions 28, a typical homeowner will place the mailbox in front of a house proximate a road or street with front door 13 closed and rear signal flap 18 in a horizontal or opened position as seen in FIG. 1. Rear bracket 21 assists in supporting signal flap 18 in its horizontal position as the terminal end of arcuate section 25 abuts the bottom surface of control bar 22 to stop further downward pivoting. In an alternate embodiment a standard 90° hinge could be used to limit or terminate the downward motion of signal flap 18. Mail delivery is made by a postman by opening front door 13 (FIG. 4) which causes signal flap 18 to rise upwardly 90° to a vertical position against rear panel 19. The opening of front door 13 causes front linkage 16 to move downwardly rotating about axle bolt 23 to push or force control bar 22 rearwardly through slot 26 whereby wheels 24, 24' engage and roll along arcuate section 25 to smoothly pivot rear bracket 21 upwardly with signal flap affixed thereto to a vertical posture whereby circular magnets 30 on signal flap 18 engage rear panel 19. Mail can be inserted into receptacle 14 and front door 13 then closed as best illustrated in FIG. 6. As front door 13 is closed front linkage 16 and control bar 22 pivot through axle bolt 23 to return to their initial position as seen in FIG. 6. Signal flap remains in the upright, vertical position assisted by magnetic attraction of magnets 30 with preferable ferromagnetic rear panel 19. Signal flap 18 is then available for viewing by a homeowner who can easily see preferred bulls-eye 39 and "YES" indicia 29 (FIG. 5) or other indicia on the outside surface of signal flap 18 when in its raised, prominent position to indicate mail delivery. The homeowner then knows that mail has been delivered and can visit mailbox 10 to retrieve mail or other delivered materials.

Front door 13 can be opened by the homeowner as convenient, the mail (not shown) removed and front door 13 thereafter closed. The homeowner then manually urges signal flap 18 downwardly to its obscure horizontal position (FIG. 1) by first disconnecting magnets 30 from rear panel 19 by finger pressure allowing signal flap 18 to rotate downwardly 90° about hinge 20 and return to its obscure opened, horizontal position as the terminal end of arcuate section 25 again abuts the bottom surface of control bar 22 to stop the downward movement. Signal flap 18 will remain in this position until front door 13 is again opened for the next mail insertion. Signal flap 18 is large, preferably approximately the size of rear panel 19 for easy indicia viewing from remote distances (100-200 feet) by those with less than perfect sight.

Figure 8:
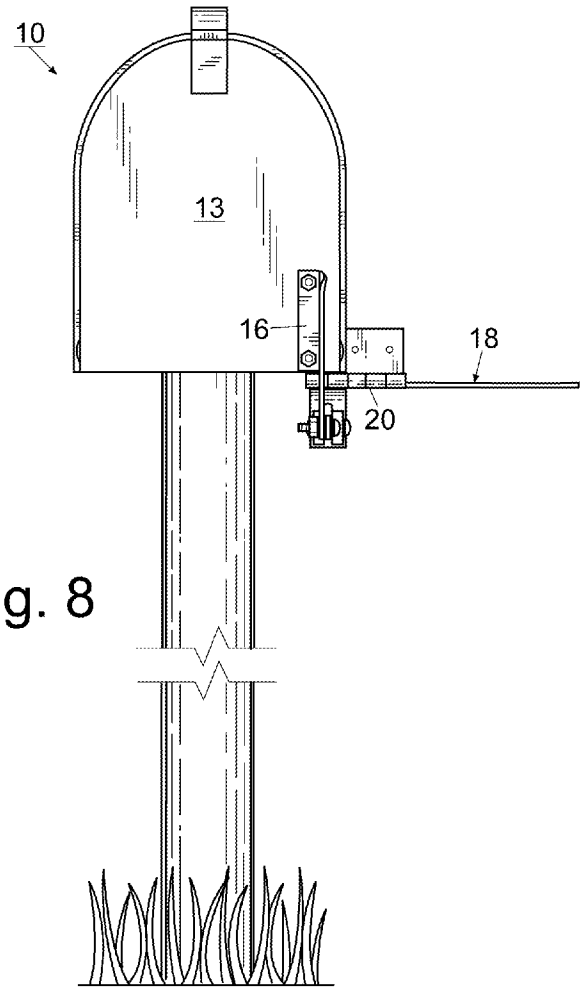
FIG. 8 pictures a front view of the embodiment seen in FIG. 7 with the signal flap lowered in a horizontal position.
Figure 7:
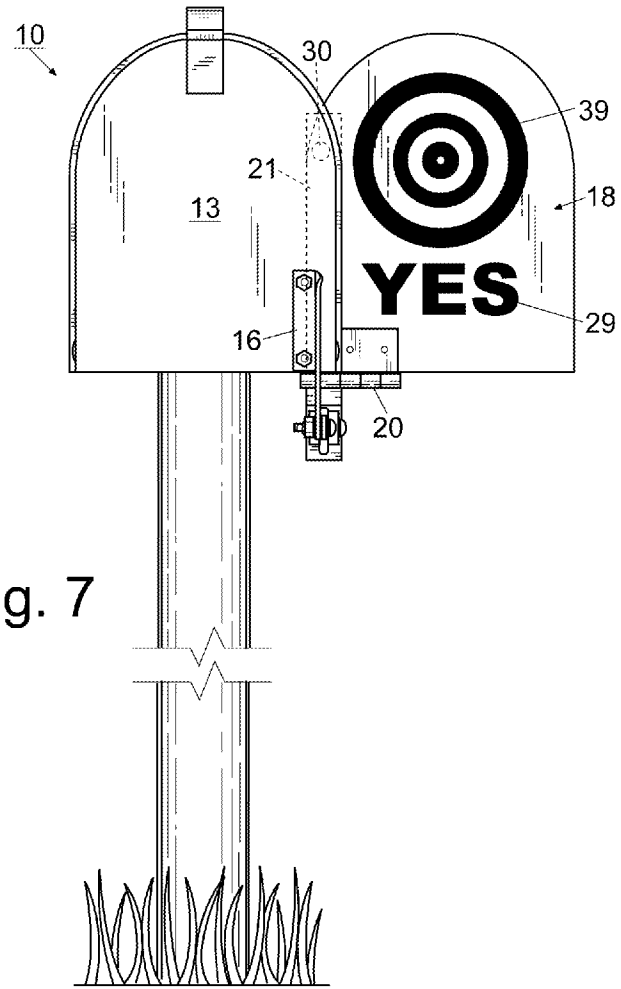
FIG. 7 depicts a front view of an alternate mailbox and signal flap embodiment with the signal flap raised.

In an alternate embodiment of the invention as shown in FIGS. 7 and 8, signal flap 18 has been reversed and moved to the right side of mailbox 10 for use by homeowners that must cross the road or street to extract mail from mailbox 10 which is viewed from the front. As seen in FIG. 7, signal flap 18 has been raised to identify mail delivery and bulls-eye 39 and "YES" indicia 29 have been positioned on the inside surface of signal flap 18. Hinge 20 has also been placed on the left bottom edge of signal flap 18 where it engages the rear of receptacle 14 for viewing the front of mailbox 10. A single magnet may be used such as magnet 30 as shown in dotted lines in FIG. 7. Rear bracket 21 is connected to the left edge of signal flap 18 during assembly which is also shown in hidden line format. Other than described, signal flap 18 generally operates as in the preferred form of the invention.

The illustrations and examples provided herein are for explanatory purposes and are not intended to limit the scope of the appended claims.

I claim:

1. A mailbox comprising: a mail receptacle, a front door, a rear panel, said front door hingedly joined to said mail receptacle, a signal flap, said signal flap pivotally attached proximate said rear panel, a control bar, a rear bracket, said rear bracket defining a planar section and an arcuate section, said planar section of said rear bracket attached to said signal flap, a front linkage, said front linkage affixed to said front door, said control bar affixed to said front linkage and slideable within said arcuate section of said rear bracket whereby opening said front door will cause said signal flap to pivot from a horizontal position to a vertical position.

2. The mailbox of claim 1 further comprising a wheel, said wheel attached to said control bar.

3. The mailbox of claim 1 further comprising a pair of wheels, said pair of wheels attached to said control bar.

4. The mailbox of claim 1 wherein said arcuate section defines a slot, said slot for receiving said control bar.

5. The mailbox of claim 3 wherein said pair of wheels engage said arcuate section to pivot said signal flap.

6. The mailbox of claim 1 further comprising a magnet, said magnet attached to said signal flap.

7. The mailbox of claim 1 wherein said signal flap contains indicia, said indicia positioned on an outside surface of said signal flap.

8. The mailbox of claim 1 wherein said front linkage is pivotally attached to said control bar.

9. The mailbox of claim 3 wherein said pair of wheels are opposingly positioned on opposite sides of said control bar.

10. A method of communicating delivery to a mailbox comprising the steps of:

a) providing a mailbox kit with components including a signal flap, a hinge, a control bar with a pair of wheels, a front linkage, and a rear bracket with an arcuate, slotted section;

b) attaching the components of the mailbox kit to the mailbox by affixing the front linkage to the mailbox front door, connecting the control bar to the front linkage attaching the signal flap to the rear of the mailbox with the hinge, attaching the rear bracket to the signal flap, and slideably engaging the control bar in the arcuate, slotted section of the rear bracket;

c) lowering the attached signal flap to a horizontal position; and d) opening the front door of the mailbox to cause the control bar to raise the signal flap to a vertical, viewable position.

11. The method of claim 10 wherein opening the front door further comprises the steps of:

a) manually pulling the front door downwardly;

b) inserting mail into the mailbox; and c) closing the front door.

12. The method of claim 11 wherein opening the front door further comprises the step of exposing indicia on the signal flap to a viewer.

* * * * *